US010946425B2

(12) United States Patent
Scharfenorth

(10) Patent No.: US 10,946,425 B2
(45) Date of Patent: Mar. 16, 2021

(54) METHOD FOR THE STEPPED ROLLING OF A METAL STRIP

(71) Applicant: Giebel Kaltwalzwerk GmbH, Iserlohn (DE)

(72) Inventor: Stephan Scharfenorth, Mettmann (DE)

(73) Assignee: Giebel Kaltwalzwerk GmbH, Iserlohn (DE)

( * ) Notice: Subject to any disclaimer, the term of this patent is extended or adjusted under 35 U.S.C. 154(b) by 385 days.

(21) Appl. No.: 15/571,534

(22) PCT Filed: May 25, 2016

(86) PCT No.: PCT/EP2016/061784

§ 371 (c)(1),
(2) Date: Nov. 3, 2017

(87) PCT Pub. No.: WO2016/193089

PCT Pub. Date: Dec. 8, 2016

(65) Prior Publication Data

US 2018/0141095 A1 May 24, 2018

(30) Foreign Application Priority Data

May 29, 2015 (EP) ..... 15169819

(51) Int. Cl.
*B21B 37/26* (2006.01)
*B21B 37/54* (2006.01)
*B21B 37/58* (2006.01)

(52) U.S. Cl.
CPC ..... *B21B 37/26* (2013.01); *B21B 37/54* (2013.01); *B21B 37/58* (2013.01); *B21B 2265/02* (2013.01); *B21B 2265/12* (2013.01)

(58) Field of Classification Search
CPC ..... B21B 37/16; B21B 37/18; B21B 37/24; B21B 37/46; B21B 37/48; B21B 37/58;
(Continued)

(56) References Cited

U.S. PATENT DOCUMENTS 5,142,891 A * 9/1992 Kuwano ..... B21B 37/18 72/11.4
6,336,349 B1 * 1/2002 Hauger ..... B21B 37/26 72/11.7

(Continued)

FOREIGN PATENT DOCUMENTS

DE 10 2004 041321 A1 3/2006
EP 1 074 317 B1 2/2005

(Continued)

OTHER PUBLICATIONS

International Search Report of PCT/EP2016/061784, dated Aug. 16, 2016.

*Primary Examiner* — Adam J Eiseman
*Assistant Examiner* — Bobby Yeonjin Kim
(74) *Attorney, Agent, or Firm* — Collard & Roe, P.C.

(57) ABSTRACT

A method for the stepped rolling of a metal strip unwinds the metal strip by a feed reel device and winds-up the metal strip by a winding reel device. The metal strip is guided through a roller gap formed between two working rollers during the rolling process, and the roller gap is changed in a controlled manner during the rolling process, whereby a thickness of the metal strip is changed in steps in the longitudinal direction during the rolling process. Tension applied to the metal strip is controlled such that the rolling force applied to the metal strip by the working rollers is constant during the rolling process.

7 Claims, 7 Drawing Sheets

(58) Field of Classification Search
CPC .... B21B 2015/0057; B21B 2015/0064; B21B 2275/02; B21B 2275/04; B21B 2275/08; B21B 2265/02; B21B 2265/04; B21B 2265/06; B21B 2265/08; B21B 38/08; B21B 38/10
See application file for complete search history.

(56) References Cited

U.S. PATENT DOCUMENTS

| | | | | |
|---|---|---|---|---|
| 2004/0177666 | A1* | 9/2004 | Brockes | B21B 37/24 72/205 |
| 2004/0255633 | A1* | 12/2004 | Hauger | B21B 37/24 72/205 |
| 2007/0261456 | A1* | 11/2007 | Jepsen | B21B 37/24 72/227 |

FOREIGN PATENT DOCUMENTS

| | | | |
|---|---|---|---|
| EP | 1 908 534 | A1 | 4/2008 |
| WO | 03/008122 | A1 | 1/2003 |

* cited by examiner

METHOD FOR THE STEPPED ROLLING OF A METAL STRIP

CROSS REFERENCE TO RELATED APPLICATIONS

This application is the National Stage of PCT/EP2016/061784 filed on May 25, 2016, which claims priority under 35 U.S.C. § 119 of European Application No. 15169819.8 filed on May 29, 2015, the disclosure of which is incorporated by reference. The international application under PCT article 21(2) was not published in English.

BACKGROUND OF THE INVENTION

1. Field of the Invention

The invention relates to a method for stepped rolling of a metal strip.

2. Description of the Related Art

Stepped rolling is already known from practice as a method for the production of metal strips, also under the term "flexible rolling." This method allows the production of metal strips that have different strip thicknesses over their length. For this purpose, the roll gap between a first working roll and a second working roll is changed in targeted manner during the rolling process. In this way, sections of the metal strip guided through the roll gap, which have different lengths or can change as desired, can be rolled with different strip thicknesses. As a result, strip sections that have a greater strip thickness and strip sections that have a lesser strip thickness are formed, distributed over the length of the metal strip. These strip sections having different thicknesses can furthermore be connected with one another by way of differently structured gradients, in other words transition sections.

Using the method of stepped rolling, it is possible to produce rolled products having cross-sectional shapes that are optimized in terms of stress and weight. The method is usually designed as strip rolling, with a decoiler apparatus and a coiler apparatus, from coil to coil. It is also generally known that strip tensions applied by way of the reel support the rolling. process and improve the levelness or straightness of the metal strip that is produced, in the longitudinal direction, in the rolling direction. A stepped rolling method is known from EP 1 908 534 A1, in which mass flow changes and strip tension changes that occur are compensated by means of drive regulations of the reel drives and additional S-roller pairs, in order to prevent disruptions of the winding process and to ensure a uniform coil tension or winding tension.

It is of particular importance that in contrast to conventional strip rolling, great changes in the rolling force always occur in stepped rolling, during the rolling process, because of the changes in thickness of the metal strip. It is true that the desired change in strip thickness is achieved, but it has the result that significant changes in the stress on the rolls and the framework occur, along with elastic deformations that accompany them. As a result, undesirable changes in the roll gap geometry and the strip geometry occur, thereby causing a negative influence on the levelness of the rolled strip. Thus, changes in the rolling force during the rolling process lead to elastic deformations of all the rolls, such as roll flattening, roll bending, and embedding into the rolls. This results in a change in the strip profile, which leads to levelness defects in the case of non-uniformities. Until now, attempts have been made to reduce these effects by means of a correction of the bending lines of the working rolls, as disclosed in EP 1 074 317 B1. Without such a correction, an uneven metal strip profile would occur in the rolling process described, which profile is characteristic for this change in load.

Corrugations of the metal strip are formed, such as edge waves or center waves, since the height change obtained and accordingly, the length change obtained are not constant over the width of the rolled material. This results in different thicknesses over the metal strip width, which lead to different lengths within the metal strip and thereby cause the said strip defects.

The levelness of the metal strip, in particular, is decisive for its further processing to be perfect, since homogeneous or the same conditions are present over the entire metal strip width only in the case of good or sufficient levelness.

In the case of a conventional strip rolling procedure for the production of simple, level metal strips having a uniform thickness over their length, not only the strip thickness but also the levelness is monitored by way of regulation circuits, and adjusted in case of deviations. A disadvantage of such regulation is that a response time and a regulation time are required for this purpose, until such a regulation has responded and the effect of a deviation has been adjusted by means of the effect of a correction.

Particularly in stepped rolling, the problem of the response of the regulation and the required regulation time until the correction plays an important role. It proves to be particularly disadvantageous that the regulation times become shorter, particularly in the case of short transitions between the steps and at high strip speeds. This leads to geometrical limits of possible stepped strips, in other words not all the desired transitions from one strip thickness to the next strip, thickness can be implemented in terms of rolling technology.

A problem can occur in the case of the methods known from the state of the art. Thus, the change in roll adjustment in stepped rolling always leads to a great change in the rolling force, and a regulation for correction of changes in the metal strip resulting from this is unsuitable for the rapid change in strip thickness in stepped rolling, because of the required response time and regulation time.

SUMMARY OF THE INVENTION

This problem is solved by means of a method having the characteristics according to the invention.

The advantages that can be achieved with the invention result from the fact that the rolling force applied by the working rolls is kept constant or approximately constant during the rolling process. As a result, negative effects such as defects that are dependent on the rolling force, for example levelness defects, are prevented in simple manner. To achieve a constant rolling force, the further process parameters must be adapted in such a manner that the rolling force does not change in spite of a change in the roll gap, in other words remains constant or approximately constant. Control of a strip tension applied to the metal strip is particularly suitable for this purpose. Such strip tension control should take place in targeted manner, in such a manner that the rolling force applied to the metal strip by the working rolls is constant or approximately constant during the rolling process. With the targeted change in the strip tensions, the result can be achieved that the rolling force remains within a constant or approximately constant level during the change in the roll gap. In stepped rolling, it has been shown that the disadvantages connected with regulation, such as response time and regulation time, are unsuitable for satisfactorily producing short, defined transitions and small radii, recurring as desired, with changing profiles. For this reason, it is advantageous if the strip tensions are set to values that can be predetermined, and are controlled, and the adaptation between two predetermined values also takes place in controlled manner. Such controlled strip tension adaptation makes it possible to compensate all effects that influence the rolling force, such as roll flattening, bending, and strip embedding, and to guarantee constant conditions for the rolling process. With a constant rolling force, it is possible to limit the defects that are dependent on the change in rolling force, in very simple and effective manner, since the elastic deformations of the roll remain the same at a constant rolling force.

In an embodiment of the invention, it is provided that the approximately constant rolling force changes during the rolling process only to the extent that the elastic deformation of the working rolls, such as roll flattening, roll bending, and strip embedding into the rolls is constant or approximately constant during the rolling process. In this way, the defects dependent on the change in rolling force can be limited in very simple and effective manner. For this purpose, the properties of the working rollers when a change in rolling force occurs are taken into consideration in such a manner that no noteworthy change in elastic deformation takes place during the rolling process.

A particular embodiment of the invention provides that a forward strip tension applied by the coiler apparatus or a reverse strip tension applied by the decoiler apparatus is controlled during the rolling process. Furthermore, it is possible to control both the forward strip tension and the reverse strip tension. Control of the strip tensions is a suitable possibility for keeping the rolling force constant or approximately constant, even if the roll gap formed between the working rolls changes.

It was recognized as being particularly advantageous that the geometry of transitions, particularly their gradient and the radii of transition points between the strip thickness of the metal strip, which thickness is changed in steps, is influenced by means of targeted strip tension control, in other words a targeted change in the forward strip tension or the reverse strip tension, or a targeted change of both strip tensions, and targeted control of the speed of rotation and setting speed of the working rolls, preferably a change in all these parameters at the same time. In this way, extension of the geometries that can be achieved by means of stepped rolling is possible. Furthermore, rolling force changes brought about by the change in the geometries and related defects in the strip geometry, profile, and levelness can be reduced. This is of particular significance since rolling force peaks easily occur during stepped rolling, at the transition points, and these peaks disadvantageously affect the stability of the rolling process. Transition points that occur between a negative gradient, which forms as the result of a reduction in the roll gap, and a subsequent flatter, planar level have been identified as being particularly critical in this connection. At these transition points, the rolling force increases very greatly without further measures, and this leads to the problems that have already been described.

A further embodiment of the invention provides that in order to reduce the strip thickness, the roll gap is reduced in size and the forward strip tension and the reverse strip tension are increased in order to obtain a constant or approximately constant rolling force. Without increasing these strip tensions, a reduction in the size of the roll gap, in particular, regularly leads to an increase in the rolling force, causing the problems for the rolling process that have already been described to occur. Simultaneous control of the strip tensions in the forward and reverse direction, in other words the belt tensions of the decoiler apparatus and also of the coiler apparatus, during a reduction in size of the roll gap, by means of setting the working rolls, is particularly advantageous. The change in rolling force during setting of the working rolls can be prevented or reduced with targeted control of the strip tensions.

It is furthermore advantageous if, in order to increase the strip thickness, the roll gap is increased in size, and the forward strip tension and the reverse strip tension are lowered in order to maintain a constant or approximately constant rolling force. With this control, the rolling force can be kept at a constant or approximately constant level.

It has proven to be a particularly advantageous embodiment if the setting speed of the working rolls or the speed of rotation of the working rolls or both the speed of rotation and the setting speed of the working rolls are controlled in accordance with precalculated data. The speeds of rotation of the decoiler apparatus or of the coiler apparatus, as well as the speeds of rotation of the two reel apparatuses can preferably also be controlled in accordance with precalculated data. Suitable parameters can be controlled in targeted manner with these precalculated speed data. The disadvantages of regulation caused by the response time and regulation time can thereby be avoided. In this way, it is possible to optimally configure the stepped rolling process and to avoid changes in rolling force that would result from a change in the roll gap. The parameters required for an optimal rolling process could be set and controlled using the precalculated speed data. The material properties and the desired geometry are taken into consideration in the calculation of the speed data.

The problem mentioned above is also solved with an apparatus that works according to the method, as described here and below, and for this purpose comprises means for carrying out the method. For this purpose, the apparatus according to the invention comprises at least two working rolls that form a roll gap, a decoiler apparatus, a coiler apparatus, and setting and control means, by means of which setting of the working rolls, the speed of rotation of the working rolls, and the speed of rotation of the decoiler apparatus and/or of the coiler apparatus can be adjusted and/or controlled.

In summary, what is essential to the invention is that in the case of a targeted change in the strip thickness, the forward and reverse tension at the roll gap is controlled in such a manner that in spite of a different change in shape, the rolling force remains approximately constant. As a result, effects that influence the levelness, such as roll flattening, bending, and strip embedding, for example, do not change or change only insignificantly, so that levelness defects that are usually caused by this do not occur.

A closed process model serves for this purpose, which model describes the forces and kinematics that are in effect in the roll gap, particularly under the effect of the strip tensions, in other words of the outer longitudinal tensions. The rolling process, particularly stepped rolling, is a three-dimensional forming process, in which a coupled force system acts in the roll gap in the longitudinal and transverse direction. Because of the interaction of the forces, the working rolls are deformed both in the radial direction and in the axial direction. These deformations, which particularly occur in the axial direction, result in different height changes in the transverse direction, and this leads to levelness defects in the strip. The rolling process is controlled by means of the process model, in such a manner that the forces in effect in the roll gap are influenced in such a manner, using targeted changes in the strip tensions, that the elastic deformations of the rolls remain approximately constant due to an approximately constant rolling force, and thereby levelness defects resulting from uncontrolled roll deformations do not occur, and a stable rolling process is achieved. In stepped rolling, it must additionally be noted that the process becomes multi-dimensionally non-stationary as the result of time-dependent variations of the strip thickness.

Keeping the rolling forces constant by means of a controlled change in the strip tensions must take these non-stationary dependencies into consideration.

BRIEF DESCRIPTION OF THE DRAWINGS

Further characteristics, details, and advantages of the invention result from the following description and from the drawings. An exemplary embodiment of the invention is shown purely schematically in the drawings, and will be described in greater detail below. Objects or elements that correspond to one another are provided with the same reference symbols in all the figures. The figures show.

DETAILED DESCRIPTION OF THE PREFERRED EMBODIMENTS

Figure 1A:
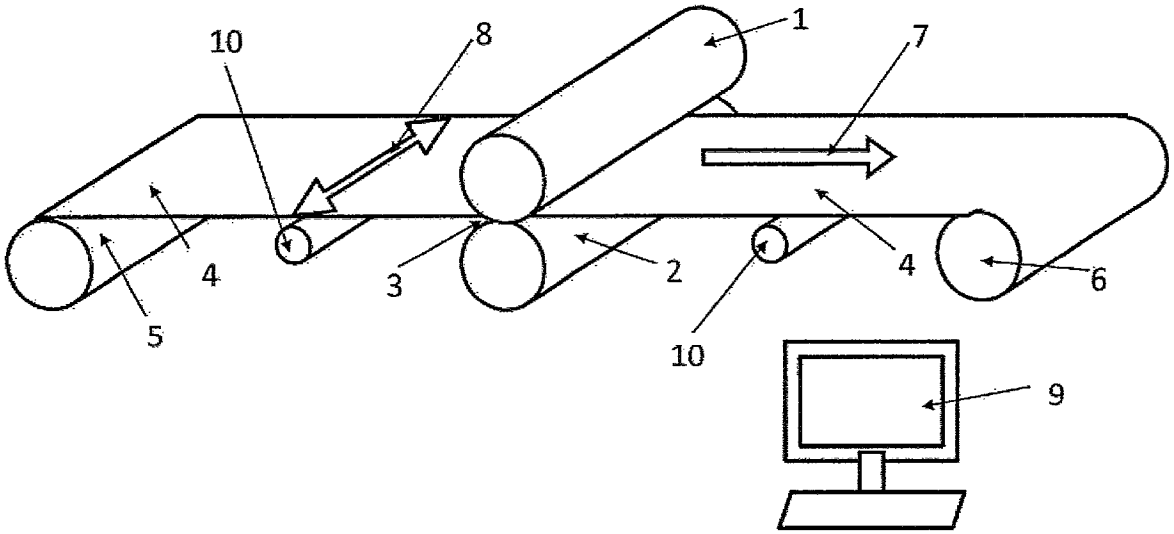
FIG. 1*a* schematic representation of an apparatus according to the invention, FIG. 1*b* schematic representation of an apparatus according to the invention, with support rolls and working rolls, FIG. 2 profile contour during rolling procedure without adaptation according to the invention, FIG. 3 rolling force progression during rolling procedure without adaptation according to the invention over time, FIG. 4 strip tension of the decoiler apparatus generated without adaptation according to the invention over time, FIG. 5 strip tension of the coiler apparatus generated without adaptation according to the invention over time, FIG. 6 profile contour during rolling procedure after adaptation according to the invention, FIG. 7 rolling force progression during rolling procedure after adaptation according to the invention over time, FIG. 8 adapted strip tension of the decoiler apparatus after adaptation according to the invention over time, FIG. 9 adapted strip tension of the coiler apparatus after adaptation according to the invention over time.

FIG. 1*a*, represented schematically, shows an apparatus according to the invention. In the exemplary embodiment shown, the metal strip 4 is guided, over its entire strip width 8, through a roll gap 3 formed by an upper working roll 1 and a lower working roll 2, in the longitudinal direction 7. In this regard, the metal strip 4 is unwound from the decoiler apparatus 5 and, after the rolling procedure, which takes place between the working rolls 1, 2, wound up by the coiler apparatus 6. As a result, the metal strip 4 moves through the roll gap 3 in the longitudinal direction 7, and is worked on by the working rolls 1, 2 over the entire strip width 8. With a change in the roll gap 3 between the working rolls 1, 2, the strip thickness of the metal strip 4 is changed in stepped manner in the longitudinal direction 7, during the rolling process, and in this way a profile contour 11 (FIGS. 2 and 6) is achieved. The profile contour 11 (FIGS. 2 and 6) occurs over the entire strip width 8, in that preferably, the setting speed and the speed of rotation of the working rolls 1, 2, the speed of rotation of the decoiler apparatus 5 and of the coiler apparatus 6 are controlled by means of a controller 9, according to precalculated speed data, and set by way of setting means (not shown).

Figure 1B:
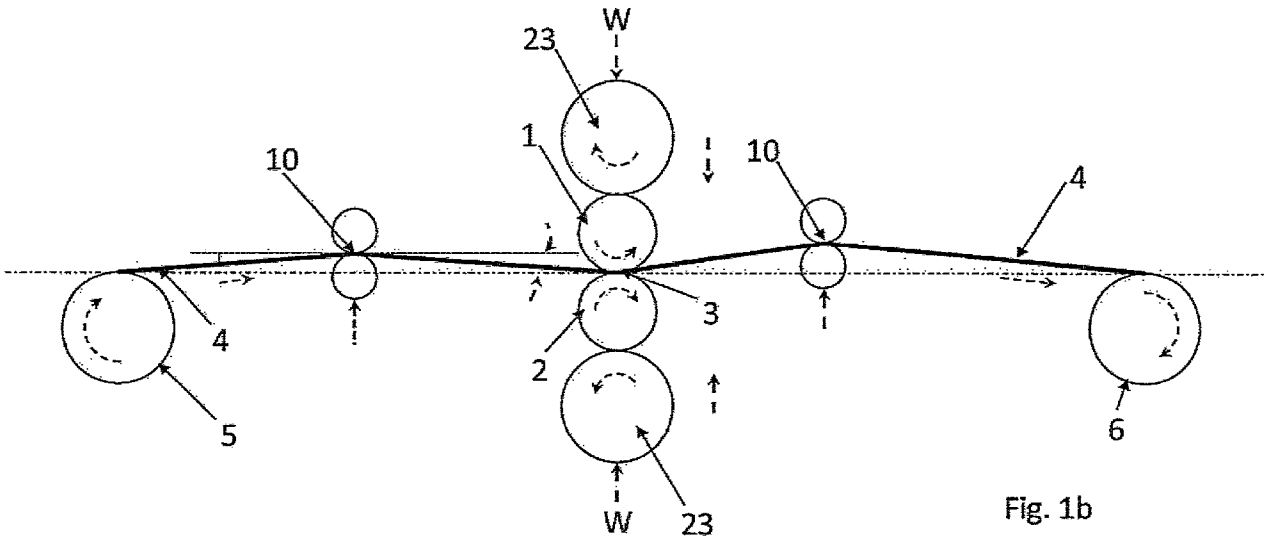

In FIG. 1*b*, a single-framework 4-roll reversing framework is shown schematically from the roll axis direction. The working rolls 1, 2 are supported by two support rolls 23. The broken-line arrows represent forces, speeds, and torques, and are supposed to illustrate the rolling process.

Figure 2:
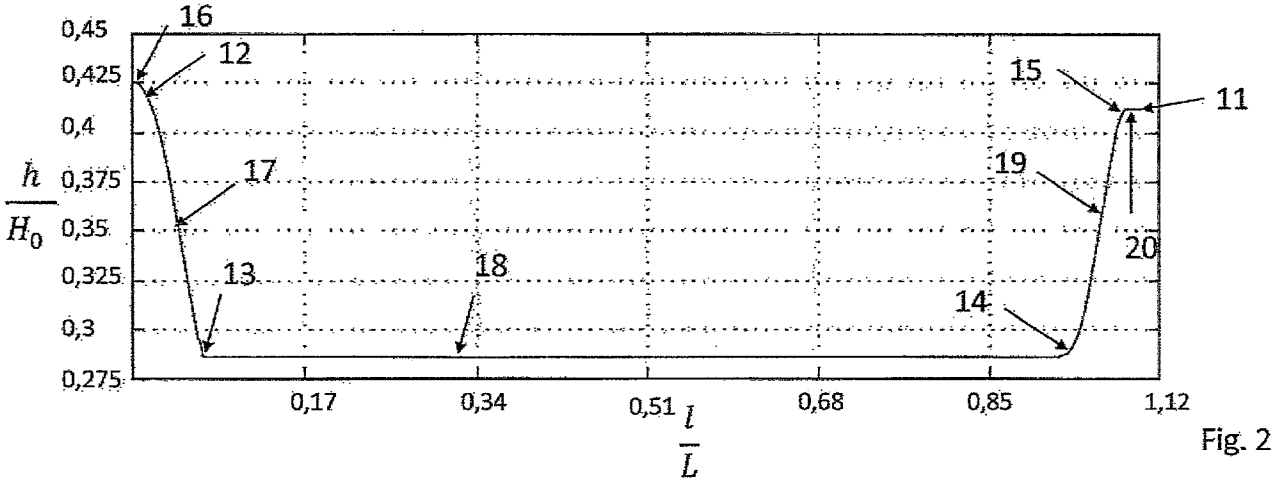
Figure 6:
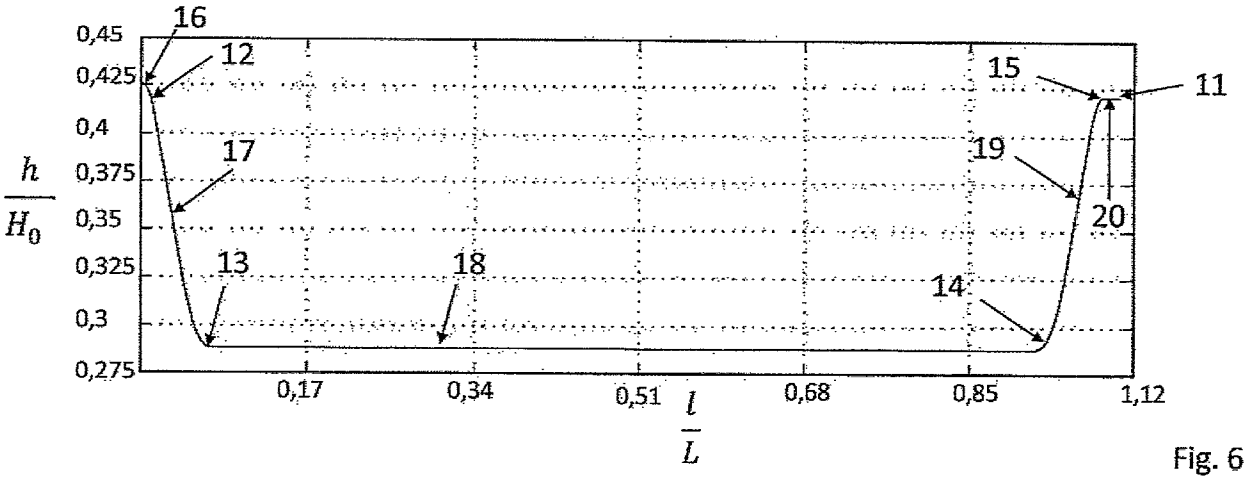

The drawings according to FIG. 2 and FIG. 6, as a diagram, show the profile contour 11 of a metal strip 4 (FIG. 1*a*), as an example, which strip has a length L after a rolling procedure, with the diagram reaching from 0 L to 1.12 L. Here, "L" represents a freely selectable value for the profile length produced. The profile height h plotted in the diagram is measured from the center of the metal strip 4 (FIG. 1*a*), in the height direction, and for this reason, the metal strip 4 (FIG. 1*a*) has twice as high a metal strip thickness after the rolling process. In the examples considered below, a metal strip 4 (FIG. 1*a*) having an intake thickness of $H_0$ is used, wherein "$H_0$" is any desired value for the intake thickness and preferably lies between 1.2 mm and 5 mm. During this rolling process, the strip thickness is reduced to a profile height h of 0.425 $H_0$, in other words a metal strip thickness of 0.85 $H_0$, wherein subsequently, further stepped setting of the working rolls 1, 2 (FIG. 1*a*) is undertaken, and the material strip 4 is reduced, in sections, to a profile height h of 0.2875 $H_0$, in other words a metal strip thickness of 0.575 $H_0$. Transitions are situated between the level sections, level 16, level 18, level 20 of the metal strip profile 11, which transitions have a gradient, reference symbols 17 and 19. The profile contour 11 shown in FIG. 2 and FIG. 6 has the transition points 12, 13, 14, and 15 between the level sections level 16, level 18, level 20 and the gradients 17, 19, which points will be used for the further explanation. In FIG. 2, it can be seen that the profile contour 11 that can be achieved by means of setting of the roll deviates from the profile contour 11 according to FIG. 6, particularly at the transition point 13, to the effect that the radius that can be achieved in the transition point 13 is clearly smaller and actually can hardly be recognized in FIG. 2.

Figure 3:
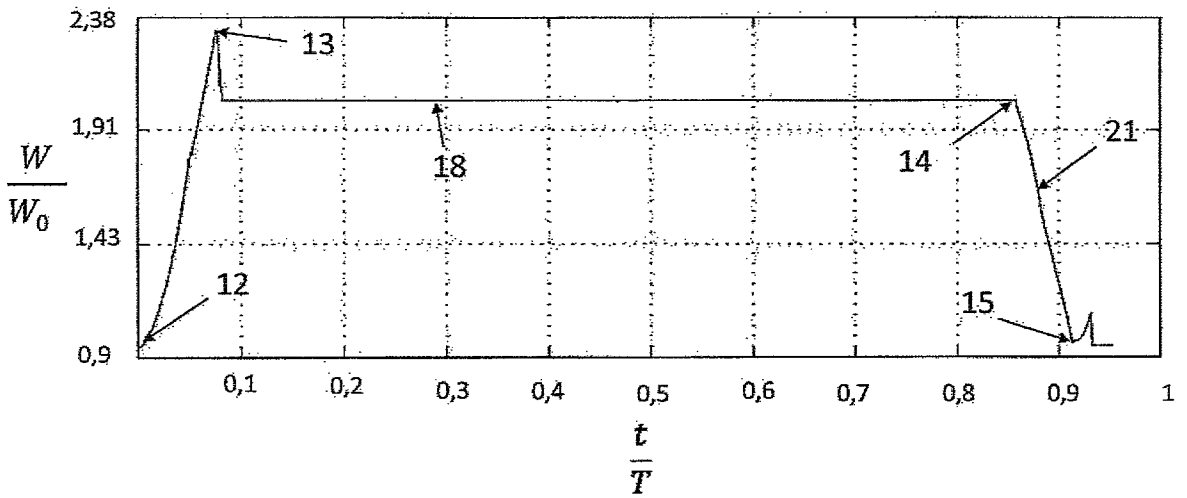

In FIG. 3, the rolling force progression 21 can be seen as a diagram over a time interval T of the rolling procedure shown in FIG. 2. The rolling force W begins with $W_0$ kN, wherein "$W_0$" is a value that occurs for the rolling force, and increases after the transition point 12 during setting of the working rolls 1, 2 (FIG. 1*a*). The rolling force W reaches its maximum at the transition point 13 with 2.32 $W_0$ kN. Subsequently, the rolling force W is constant at 2.0 $W_0$ kN during the level section, level 18, between the transition points 13 and 14, before it decreases again after the transition point 14, as a result of renewed setting of the working rolls 1, 2 (FIG. 1*a*), and reaches a value of $W_0$ kN again after the transition point 15.

Figure 4:
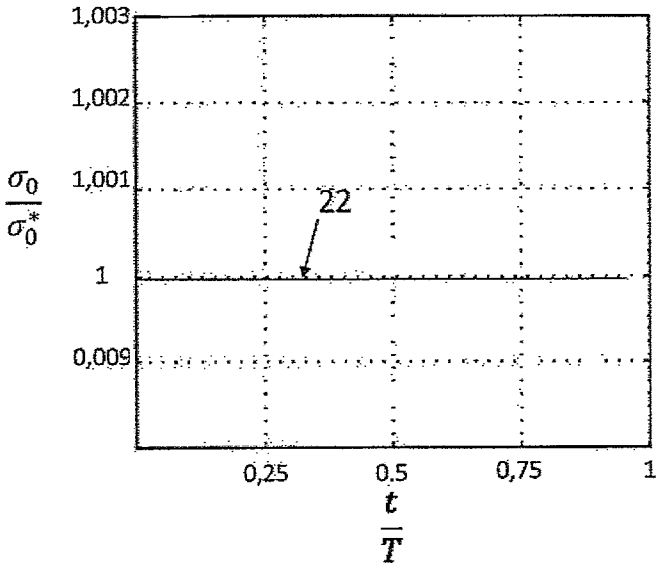
Figure 5:
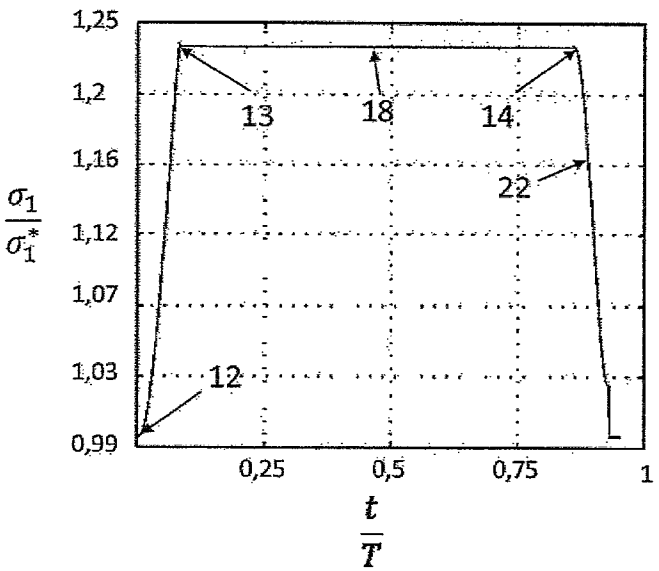

Over the same time interval T being considered, FIGS. 4 and 5 show the stress progressions of the strip tensions as a diagram.

In FIG. 4, the strain progression 22 of the reverse strip tension $\sigma_0$ of the decoiler apparatus 5 (FIG. 1*a*) can be seen, which is constant during the entire rolling process at $\sigma_0$* MPa. In contrast, the strain 22 of the forward strip tension $\sigma_1$ of the coiler apparatus 6 (FIG. 1*a*) changes during the time interval T being considered. As is evident from FIG. 5, the strain of this strip tension increases during the rolling procedure, between the transition points 12 and 13, to maximally 1.23 $\sigma_1$* MPa, before the strain drops again after the transition point 14. $\sigma_0$* and $\sigma_1$* represent strain values that lie in the range of 15% to 60% of the flow strain at the strip-profile position being considered.

FIG. 6, as an example, shows the profile contour 11 of the metal strip 4 (FIG. 1*a*) after a rolling procedure. As has already been mentioned above, the strip thickness is reduced to a profile height h of 0.425 $H_0$, in other words a metal strip thickness of 0.85 $H_0$, wherein subsequently, stepped setting of the working rolls 1, 2 (FIG. 1*a*) is undertaken, and the material strip 4 (FIG. 1*a*) is reduced, in sections, to a profile height of 0.2875 $H_0$, in other words a metal strip thickness of 0.575 $H_0$. There are transitions between the level sections, level 16, level 18, level 20 of the metal strip profile 11, which transitions have a gradient, reference symbol 17 and 19. In FIG. 6, it can be seen that the profile contour 11 that can be achieved by setting of the rolls 1, 2 (FIG. 1 *a*) deviates from the profile contour 11 according to FIG. 2, particularly at the transition point 13, to the effect that the radius that can be achieved in the transition point 13 is clearly greater and corresponds to the radius in the transition point 14. This profile contour 11 is only possible by means of targeted adaptation of the strip tensions, roll speed of rotation, and setting speed during the rolling process.

Figure 7:
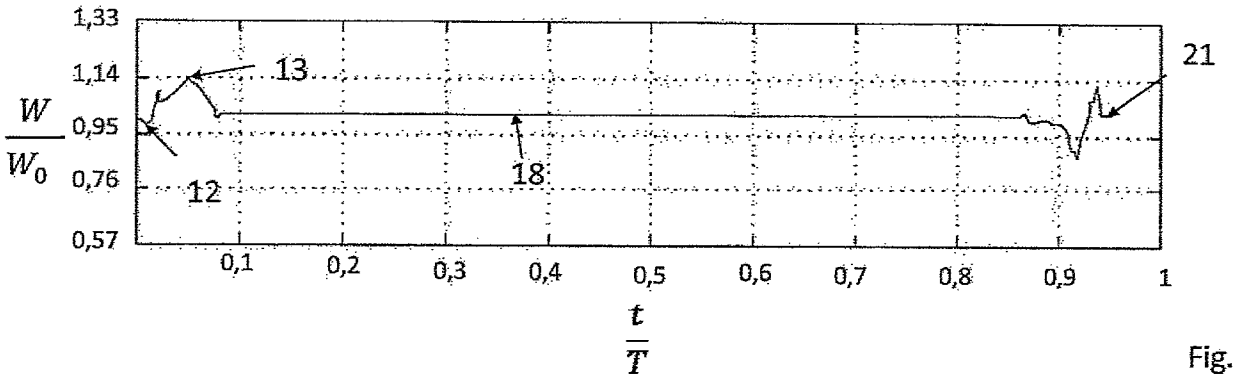

The diagram that is evident from FIG. 7 shows the rolling force progression 21 over the time interval T of the rolling procedure shown in FIG. 6. The rolling force W begins at $W_0$ kN and increases minimally after the transition point 12, during setting of the working rolls 1, 2 (FIG. 1*a*). The rolling force W reaches its maximum at the transition point 13, with just 1.14 $W_0$ kN. Subsequently, the rolling force W is constant during the level section, level 18, between the transition points 13 and 14, before it decreases again after the transition point 14, as a result of renewed setting of the working rolls 1, 2 (FIG. 1*a*), and reaches a value of $W_0$ kN again after the transition point 15.

Figure 8:
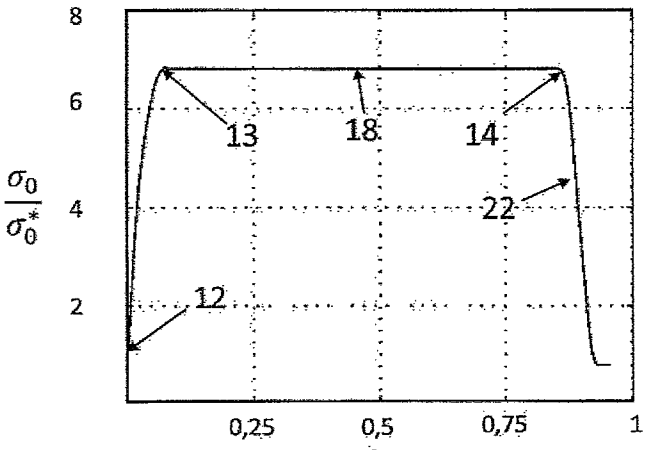
Figure 9:
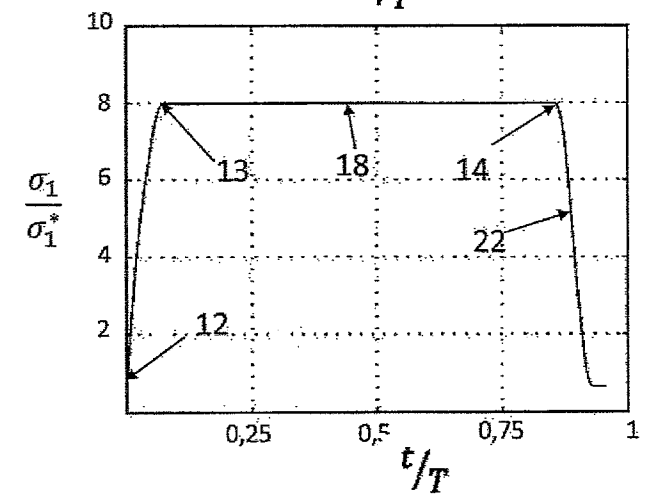

Over the same time interval T being considered, FIGS. 8 and 9 show the strain progressions of the strip tensions in diagrams. In FIG. 8, the strain progression 22 of the reverse strip tension $\sigma_0$ of the decoiler apparatus 5 (FIG. 1*a*) can be seen, which is adapted during the rolling process. The strip tension is adapted to a tension strain of 6.7 $\sigma_0$* MPa during setting of the working rolls 1, 2 (FIG. 1*a*) between the transition points 12 and 13. This tension strain is maintained for the rolling process, until the transition point 14, before the strip tension of the decoiler apparatus 5 (FIG. 1*a*) is reduced again. The strain 22 of the forward strip tension $\sigma_1$ of the coiler apparatus 6 (FIG. 1*a*) also changes during the time interval T being considered. Thus, the strain 22 of this strip tension increases during the rolling procedure, between the transition points 12 and 13, to 8 $\sigma_1$* MPa, before the strain 22 drops again after the transition point 14.

The invention can be summarized as follows: An increase in the rolling force W (FIG. 1*a*) is effectively prevented in that the shape change state and the strain state in the roll gap 3 (FIG. 1*a*) is changed by means of the strip tensions $\sigma_0$, $\sigma_1$ that are applied to the metal strip 4 (FIG. 1*a*). Usually, the vertical strain increases as the result of a reduction in the roll gap, and this results in a greater rolling force W (FIG. 1*a*). With the adaptation of the strip tensions $\sigma_0$, $\sigma_1$, in contrast, the result is achieved that in order to achieve flow conditions in the roll gap 3 (FIG. 1*a*), a lower resulting vertical strain is required.

Control of the strip tensions $\sigma_0$, $\sigma_1$ takes place by way of the change in the reel speeds of rotation, wherein for targeted control of the strip tensions $\sigma_0$, $\sigma_1$, the coil diameter must be taken into consideration, so that a desired reel moment is achieved by means of the change in the reel speeds of rotation, which moment acts on the strip tensions $\sigma_0$, $\sigma_1$. With control of the strip tensions $\sigma_0$, $\sigma_1$, the flow condition in the roll gap 3 (FIG. 1*a*) is thereby achieved and maintained in targeted manner, without the vertical strains and thereby the rolling force W (FIG. 1*a*) being significantly changed as a result. Of course, the exemplary embodiment of the invention, as described, can still by modified in multiple respects, without departing from the basic idea.

REFERENCE SYMBOL LIST

1 upper working roll (upper roll)
2 lower working roll (lower roll)
3 roll gap
4 metal strip
5 decoiler apparatus
6 coiler apparatus
7 longitudinal direction
8 strip width
9 controller
10 strip tension measurement roller
11 profile contour
12, 13, 14, 15 transition point
16 level
17 gradient
18 level
19 gradient
20 level
21 rolling force progression
22 strain progression
23 support rolls
W rolling force in kN
$W_0$ starting value for rolling force
h profile height in mm
$H_0$ intake thickness of the metal strip
l rolled profile length in mm
L value for total profile length,
t time in s
T time interval
$\sigma_0$ reverse strip tension in MPa
$\sigma_{0*}$ starting value for reverse strip tension
$\sigma_1$ forward strip tension in MPa
$\sigma_1$* starting value for forward strip tension

The invention claimed is:

1. A method for stepped rolling of a metal strip, the method comprising: unwinding the metal strip from a decoiler apparatus, guiding the metal strip through a roll gap formed between two working rolls, changing the roll gap in targeted manner such that a strip thickness of the metal strip is changed in stepped manner, in a longitudinal direction, and concurrently controlling a strip tension applied to the metal strip, in targeted manner, so that a rolling force applied to the metal strip by the two working rolls and an elastic deformation of the two working rolls are approximately constant, and winding up the metal strip by a coiler apparatus.

2. The method according to claim 1, further comprising:
controlling a forward strip tension applied to the coiler apparatus and/or controlling a reverse strip tension applied by the decoiler apparatus.

3. The method according to claim 2, further comprising:
reducing the roll gap for reduction of the strip thickness, and
controlling a forward strip tension applied to the coiler apparatus and increasing the forward strip tension, or
controlling a reverse strip tension applied by the decoiler apparatus and increasing the reverse strip tension, or controlling a forward strip tension applied to the coiler apparatus and a reverse strip tension applied strip tension applied by the decoiler apparatus and increasing the forward strip tension and/or and the reverse strip tension.

4. The method according to claim 2, further comprising:

increasing the roll gap in size for increasing the strip thickness, and controlling a forward strip tension applied to the coiler apparatus and lowering the forward strip tension, or controlling a reverse strip tension applied by the decoiler apparatus and lowering the reverse strip tension, or controlling a forward strip tension applied to the coiler apparatus and a reverse strip tension applied strip tension applied by the decoiler apparatus and lowering the forward strip tension and the reverse strip tension.

5. The method according to claim 1, further comprising:

controlling in accordance with precalculated speed data:

a setting speed of the working rolls and/or a speed of rotation of the working rolls, and/or a speed of rotation of the decoiler apparatus and/or a speed of rotation of the coiler apparatus.

6. A method for stepped rolling of a metal strip, the method comprising: unwinding the metal strip from a decoiler apparatus, guiding the metal strip through a roll gap formed between two working rolls, changing the roll gap in targeted manner such that a strip thickness of the metal strip is changed in stepped manner, in a longitudinal direction, and concurrently controlling a strip tension applied to the metal strip, in targeted manner, so that a rolling force applied to the metal strip by the two working rolls is approximately constant, influencing a geometry of transitions between the strip thickness of the metal strip via targeted strip tension control and targeted control of the speed of rotation and setting speed of the working rolls, and winding up the metal strip by a coiler apparatus.

7. The method according to claim 6, wherein the geometry of transitions comprises a gradient and radii of transition points.

* * * * *